US009706836B1

(12) United States Patent
Nelson

(10) Patent No.: US 9,706,836 B1
(45) Date of Patent: Jul. 18, 2017

(54) ADJUSTABLE SHELVING STRUCTURE

(71) Applicant: Todd Nelson, Prescott, WI (US)

(72) Inventor: Todd Nelson, Prescott, WI (US)

( * ) Notice: Subject to any disclaimer, the term of this patent is extended or adjusted under 35 U.S.C. 154(b) by 0 days.

(21) Appl. No.: 15/143,996

(22) Filed: May 2, 2016

Related U.S. Application Data

(60) Provisional application No. 62/156,964, filed on May 5, 2015.

(51) Int. Cl.

| | |
|---|---|
| ***A47B 43/00*** | (2006.01) |
| ***A47B 47/00*** | (2006.01) |
| ***A47B 57/00*** | (2006.01) |
| ***A47B 57/06*** | (2006.01) |
| ***A47B 96/14*** | (2006.01) |
| ***A47B 96/02*** | (2006.01) |
| ***A47B 96/06*** | (2006.01) |
| ***A47F 5/10*** | (2006.01) |

(52) U.S. Cl.
CPC ..... *A47B 57/06* (2013.01); *A47B 43/006* (2013.01); *A47B 96/021* (2013.01); *A47B 96/06* (2013.01); *A47B 96/14* (2013.01); *A47F 5/10* (2013.01)

(58) Field of Classification Search
CPC ..... A47B 57/06; A47B 96/021; A47B 96/06; A47B 96/14; A47B 43/00; A47B 43/003; A47B 43/006; A47B 47/0083; A47B 47/045; A47B 3/12; A47B 47/00; A47F 3/142; A47F 5/0043; A47F 5/0081; A47F 5/0892; A47F 5/10; A47F 5/16; A47F 2005/165; A47F 7/145; A47F 7/147; A47F 5/00
USPC ..... 211/187, 59.3, 190, 182, 180, 103; 108/180, 186, 147.11, 147.12, 106, 107, 108/101, 153.1, 92, 93
See application file for complete search history.

(56) References Cited

U.S. PATENT DOCUMENTS

| | | | | | |
|---|---|---|---|---|---|
| 900,331 | A | * | 10/1908 | Weston | A47F 5/10 108/101 |
| 1,893,755 | A | * | 1/1933 | Wentworth | A47J 47/16 211/126.12 |
| 2,206,753 | A | * | 7/1940 | Roth | A47B 43/006 108/164 |
| 2,433,748 | A | * | 12/1947 | Eide | A47F 5/10 108/101 |
| 3,025,970 | A | * | 3/1962 | Ostrom | A47B 43/006 108/96 |
| 3,137,522 | A | * | 6/1964 | Smith | A47B 3/02 108/101 |

(Continued)

*Primary Examiner* — Jennifer E Novosad

(57) ABSTRACT

The disclosure defined by this invention is of a shelving system where the top and bottom shelf positions are fixed relative to each other by a plurality of support columns, and one or more inner shelves are vertically positionable by hand. The support columns pass through guide channels in a shelf, or in brackets attached to the shelves, and are forced to bend slightly to do so. The channels are larger than the support columns. The bent support columns exert opposing lateral forces against a shelf at the guide channel walls and edges and the friction between the support columns and the guide channels enables a shelf to remain stuck in a position even when under load. Force can be applied by hand to overcome the stuck position and slide a shelf to a new vertical position. Inner shelves can be finely positioned thru a finite vertical range.

14 Claims, 9 Drawing Sheets

(56) References Cited

U.S. PATENT DOCUMENTS 3,437,060 A * 4/1969 Giambalvo ..... A47B 57/26 108/101
4,189,030 A * 2/1980 Leslie ..... E06C 1/56 182/196
4,295,432 A * 10/1981 Hulke ..... A47B 43/006 108/149
4,359,947 A * 11/1982 Marschak ..... A47B 57/04 108/1
4,480,756 A * 11/1984 Belokin, Jr. ..... A47B 47/06 108/180
4,523,526 A * 6/1985 O'Neill ..... A47B 43/006 108/149
4,589,351 A * 5/1986 Love ..... A47B 43/006 108/105
4,634,009 A * 1/1987 Gassaway ..... E05B 73/00 211/4
5,176,266 A * 1/1993 Gillet ..... A47B 96/06 108/106
5,238,128 A * 8/1993 Stoddard ..... A47F 5/005 211/133.1
5,542,530 A * 8/1996 Freelander ..... A47B 61/00 108/106
5,752,611 A * 5/1998 Nakagawa ..... A47F 5/0062 211/186
5,779,070 A * 7/1998 Dickinson ..... A47B 57/265 211/181.1
5,941,400 A * 8/1999 Lemaire ..... A47B 43/00 211/167
6,029,584 A * 2/2000 Cochrane ..... A47B 13/02 108/101
6,116,164 A * 9/2000 Justen, Jr. ..... A47B 43/006 108/42
6,354,232 B1 * 3/2002 Hulke ..... A47B 43/003 108/149
6,595,145 B1 * 7/2003 Lietz ..... A47B 43/006 108/106
6,814,418 B2 * 11/2004 D'Orso ..... A47B 61/04 108/149
6,971,529 B1 * 12/2005 Shapiro ..... A47B 47/00 211/188
7,624,479 B1 * 12/2009 Lin ..... A47B 43/006 24/135 N
7,651,065 B2 * 1/2010 Sloan ..... A47B 47/00 211/90.01
8,356,720 B2 * 1/2013 Mathews ..... A47B 43/006 108/149
8,967,402 B2 * 3/2015 Pintur ..... A47F 5/0018 211/103
2001/0004064 A1 * 6/2001 Battaglia ..... A47B 57/54 211/187
2003/0164347 A1 * 9/2003 Bouvier, Jr. ..... A47B 43/006 211/117
2004/0173551 A1 * 9/2004 Wu ..... A47B 57/54 211/187
2006/0049124 A1 * 3/2006 Wang ..... A47B 43/003 211/113
2006/0186071 A1 * 8/2006 Rowan ..... A47B 43/006 211/113
2008/0116160 A1 * 5/2008 McNicholas ..... A47B 43/003 211/118
2010/0096352 A1 * 4/2010 Wang ..... A47B 47/045 211/187
2010/0133217 A1 * 6/2010 Wang ..... A47G 29/00 211/118
2010/0213150 A1 * 8/2010 Wang ..... A47G 29/08 211/90.01
2012/0292276 A1 * 11/2012 Hoch ..... A47B 43/003 211/90.02
2013/0032560 A1 * 2/2013 Gregory ..... A47B 43/006 211/153
2014/0263130 A1 * 9/2014 Davis ..... A47B 47/0075 211/182
2015/0083682 A1 * 3/2015 Barre ..... A47B 43/003 211/118

* cited by examiner

ADJUSTABLE SHELVING STRUCTURE

BACKGROUND

The field of the present invention relates to shelving systems. More particularly, it relates to adjustable shelve shelving systems. Most importantly it relates to how shelves are moved and adjusted and held in place. Typical shelving systems have permanently affixed shelves, or have positionable shelves that require tools to reposition, or require removal and replacement of shelves to reposition, and/or require additional parts to reposition, and typically can only be positioned at predetermined points.

BRIEF SUMMARY OF THE INVENTION

The present invention is a shelving system where the shelves can be moved by hand (with no tools) up or down within the framework of the invention, and can be finely positioned by hand within a finite vertical range. A framework of elastically deflected support columns exert a lateral force against the shelves which impedes shelf slippage under normal loads, but permits shelf slippage and repositioning when enough vertical force is applied by hand.

BRIEF DESCRIPTION OF THE DRAWINGS

FIG. 16 is a parallel projection section view of a hybrid guide channel that is parallel walled and also catinoid like.

DETAILED DESCRIPTION AND BEST MODE OF IMPLEMENTATION

Figure 1:
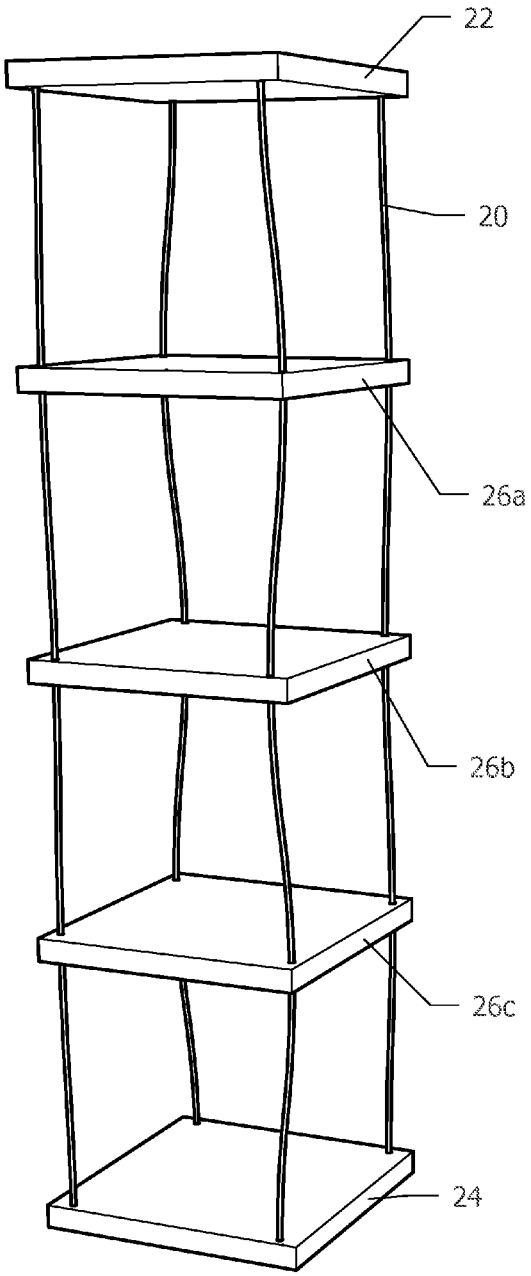
FIG. 1 is a perspective view of a five shelve embodiment of the present invention.
Figure 2:
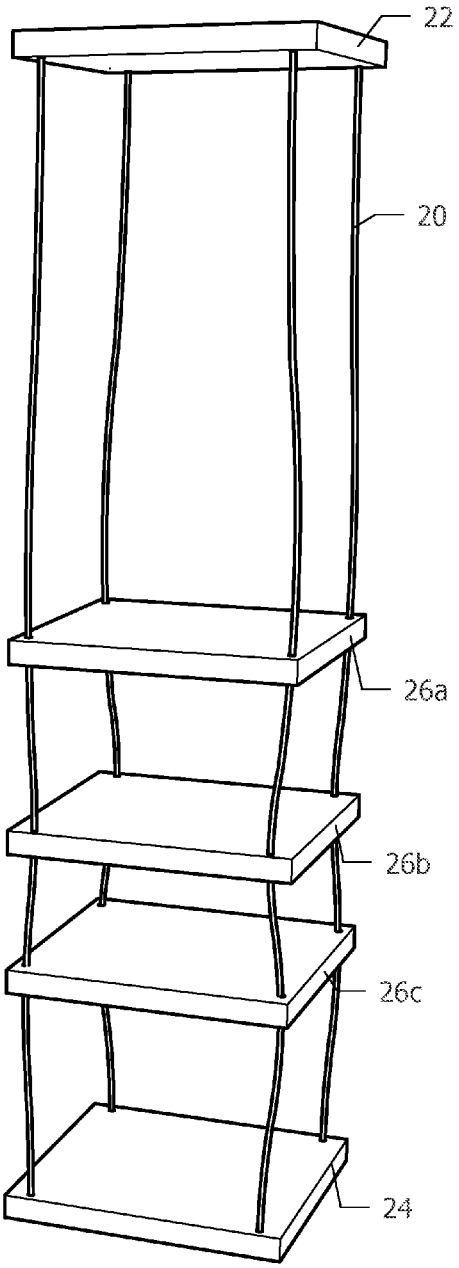
FIG. 2 is a perspective view of the embodiment shown in FIG. 1 with the inner shelves re-positioned.

FIG. 1 shows a five shelve embodiment of the present invention. A plurality of support columns 20 are affixed to the top shelve 22, and the bottom shelve 24. The three inner shelve 26*a*, 26*b*, 26*c* are being held in vertical position by the lateral force exerted against them by the elastically bent support columns 20. FIG. 2 shows the embodiment shown in FIG. 1 with the three inner shelves 26*a*, 26*b*, 26*c* vertically slid and repositioned as the elastic support columns 20 continue to exert a lateral force against the shelves.

Figure 3:
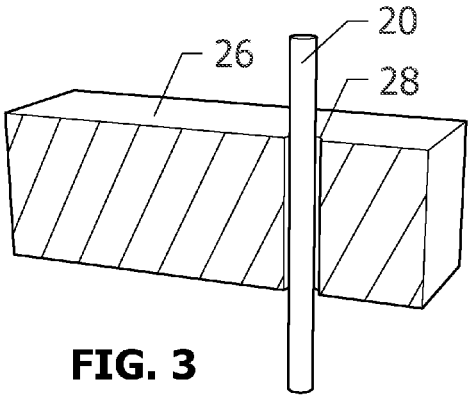
FIG. 3 shows a perspective section view of a support column passing through a cylindrical guide channel in a shelf.

Shelves 22, 24, 26*a*, 26*b*, 26*c* are composed of any material of sufficient strength to oppose the lateral force exerted on them by the deflected elastic support columns 20 without deforming in any significant manner, a material such as; wood, acetal, or steel. Support columns 20 are composed of any material that can be deflected by the inner shelves 26*a*, 26*b*, 26*c* while still exerting a lateral force of sufficient strength to impede vertical movement of the inner shelves, an elastic material such as; steel, wood, fiberglass, or carbon fibers composite. Support columns 20 may be solid rods or hollow tubes and may in cross section be circular, oval, square, rectangular, or of irregular shape. FIG. 3 is a section view showing a cylindrical support column 20 passing through a cylindrical guide channel 28 of an inner shelve 26. The guide channel 28 is typical of all guide channels in that it is of a size that is larger than the cross section of the support column and would allow the support column to pass freely through if the support column was in a straight non-deflected state. In practice the support columns are always defected by the guide channels as that is integral to how the present invention works. FIG. 3 simply shows that the guide channel is larger than the support column.

Figure 5:
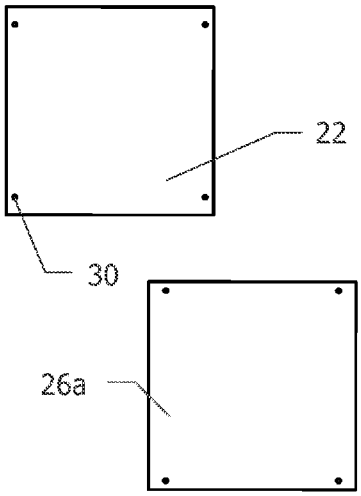
FIG. 5 shows an elevation view of FIG. 1.
Figure 5:
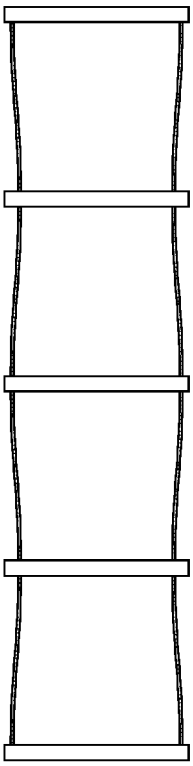
Figure 6:
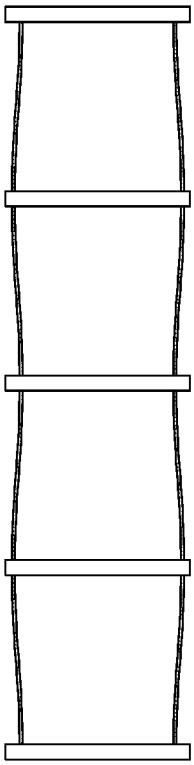
FIG. 6 shows an elevation view of FIG. 5 rotated 90 degrees.
Figure 4:
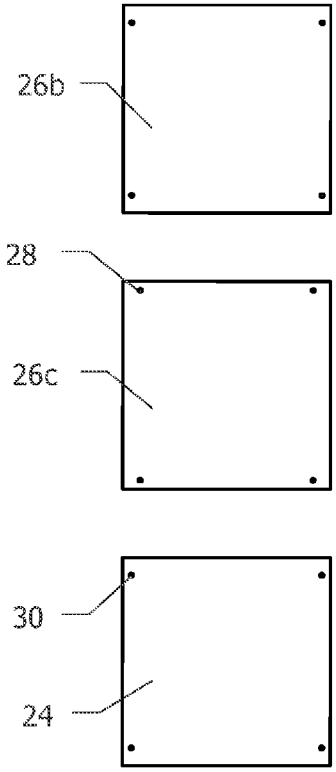
FIG. 4 shows a plan view of the component shelves from FIG. 1 and the guide channels and anchor holes in them.

FIG. 4 shows the shelf components used in the embodiment shown in FIG. 1 and FIG. 2, and the placement of a plurality of guide channels 28 passing through the three inner shelves 26*a*, 26*b*, 26*c*, and the placement of a plurality of anchor holes 30 in the bottom shelf 22 and top shelf 24. The top shelve 22 is shown in an upside down position relative to the other shelves so the anchor holes 30 can be seen. The guide channels 28 and the anchor holes 30 in any given corner are staggered back and forth along the vertical axis from the bottom shelve 24 through the inner shelves 26*a*, 26*b*, 26*c*, to the top shelve 22. FIG. 5 and FIG. 6 show how the support columns bend in the two vertical planes. Top shelf 22 and bottom shelf 24 are different then the three internal shelves in that the support column ends are firmly affixed to them at the anchor holes. Anchor holes are different then guide channels in that support columns do not necessarily pass all the way through a shelf, and the support column ends are firmly embedded in them. To anchor the support columns ends, the support column ends can be inserted into holes that are smaller than the size of the support columns, forming a firm interference fit anchorage. Or the support columns ends can be glued into anchor holes slightly larger than the support columns ends. Or the support column ends can be firmly affixed in the anchor holes by some mechanically manner: for example a pin that passes through part of the shelf and perpendicularly through the support column end. Or the support column ends can be retained at the surfaces of the top or bottom shelves in some mechanical manner, such as with a bracket or brackets with screws or glue. In the embodiment of the present invention shown in FIG. 1, the support column ends are affixed to the top and bottom shelves such that the support columns can't pivot. In another embodiment of the present invention, the support columns ends can be anchored at the top shelf and bottom shelf anchor points, and allowed to pivot around one or both horizontal axis.

FIG. 1 shows the support columns pass through the guide channels of inner shelves 26*a*, 26*b*, 26*c* and are forced to bend to pass through the staggered guide channels. For any support column, the offset between guide channels on adjacent shelves needs to be enough to create sufficient lateral force against a shelf to resist vertical movement of the shelf under static load, but not so much lateral force that the shelf can't be moved by applying more vertical force by hand. For any support column, an offset of the guide channels of sufficient distance to create shelve supporting lateral force, limits the range of vertical adjustment of a shelf such that adjacent shelves can never come in contact with each other. As one shelf is positioned closer to another shelf, the support columns are forced to bend around an ever smaller radius and before the shelves meet, the force of bending the support columns is prohibitively high and reaches a physical limit that to pass this limit would entail damaging or breaking the shelves and or the support columns. The practical range of vertical positioning is realized as being limited by the amount of force that can be reasonably applied using moderate force by hand, and applying ones intrinsic sense of material tolerances. Practical inner shelf positioning limits can be determined empirically for overall embodiment size, shelf strength, support column strength, support column elasticity, support column cross section shape and size, guide channel size in proportion to support column size, guide channel shape, guide channels offsets, shelf thickness, guide channel contour, the coefficient of kinetic friction and the coefficient of static friction between the shelves and the support columns, shelf load, and other less significant variables. It should be possible to calculate the allowable positioning range analytically, but the inventor does not possess the analytical skills at this time to do so. But as stated above, a practical range of shelf positions can be satisfactorily determined empirically.

If the coefficient of friction between the shelves and the support columns where zero or near enough to zero, the inner shelves of the disclosed invention would slide and take up positions that balance the bending forces. With the shelves unloaded, they would tend to equally space themselves. Without some friction, the shelving system would not work. Because there is a satisfactory coefficient of friction between the shelves and the support columns, the shelves will stay in place and carry a load when positioned within the allowed vertical range. A plurality of wood species for shelves and stainless steel rods for support columns have a coefficient of friction in the range that is effective in this invention.

Figure 7:
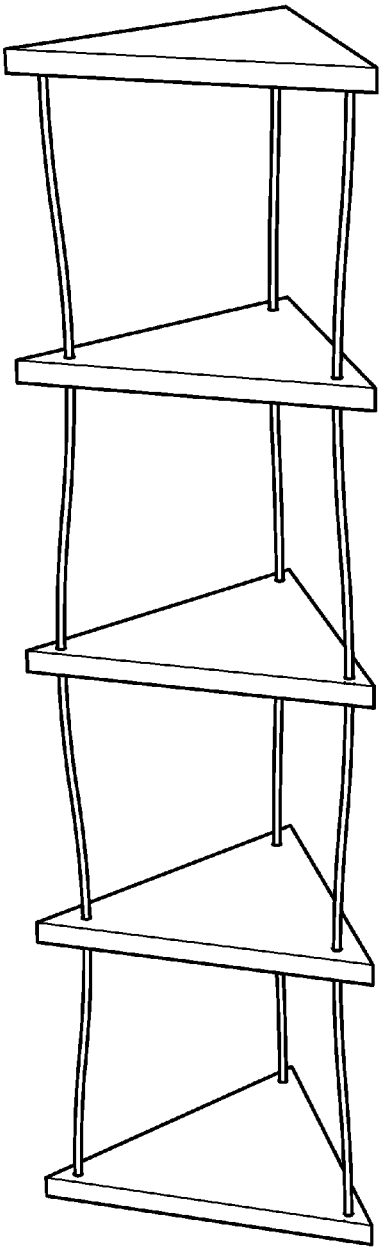
FIG. 7 is a perspective view of an embodiment of the present invention with three support columns and five shelves.
Figure 8:
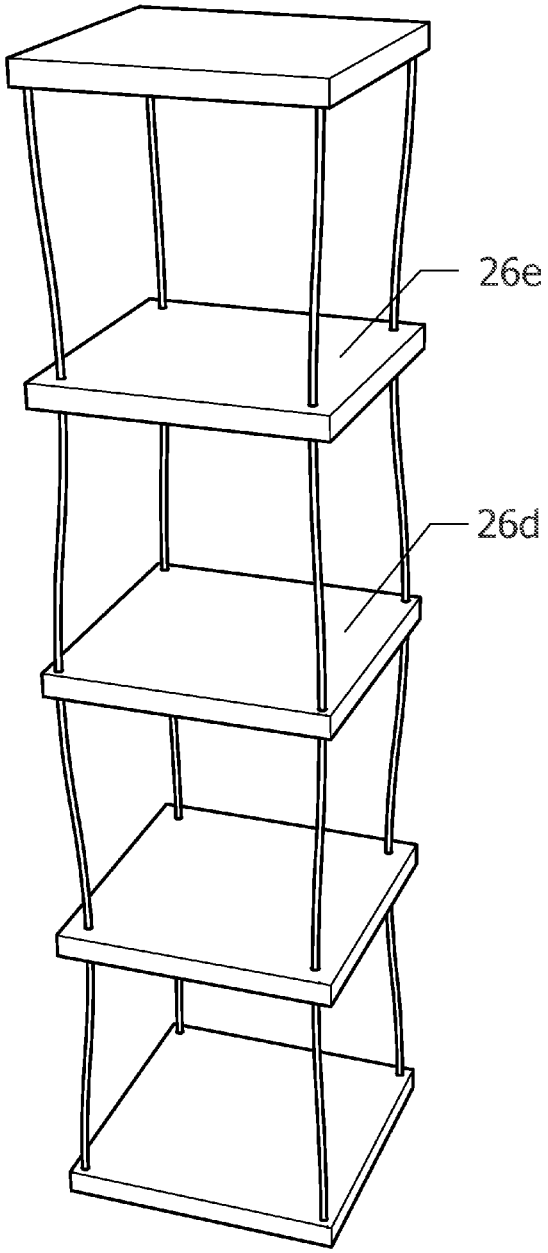
FIG. 8 is a perspective view of an embodiment of the present invention with four support columns and five shelves.

As one support column exerts a lateral force against a shelf, other support columns also exert lateral forces that oppose and balance the lateral forces on any given shelve. When the anchor holes and guide channels are arrayed in a symmetrical manner, the shelves will align vertically, regardless of their vertical positions, provided the shelves are positioned substantially horizontally. FIG. 7 shows triangular shelves with support columns passing through the corners in bending opposition. Any one support column's lateral force exertion is opposed by the other two support columns. FIG. 8 shows four support columns arrayed in a symmetrical pattern where any single support column's exerted lateral force, is equally opposed by the lateral force exerted by the support column in the opposite corner. The guide channel stagger pattern of the embodiments shown in FIG. 7 and FIG. 8 force all the support columns to exert lateral forces inward on one shelf and then all outward on the next shelf. In FIG. 8, inner shelf 26*d* has all four support columns exerting inward lateral force, and inner shelf 26*e* has all four support columns exerting outward lateral force. In FIG. 1 the guide channels are arrayed symmetrically in a geometrical pattern from shelf to shelf (see FIG. 4 to see this pattern) such that the lateral force exerted by one support column, is balanced by the applicable additive force vector components exerted by the two support columns in adjacent corners. This applies to all four support columns and again the total force exerted on any one shelf is in balance and the shelves will align vertically. An embodiment of the present invention could use variations in guide channel geometries and/or variations in support column size and composition, such that the shelves do not align vertically. At this time only designs that use some kind of symmetric guide channels pattern or combinations of symmetric guide channel patterns—where the shelves remain vertically aligned regardless of vertical position—are examined.

Figure 9:
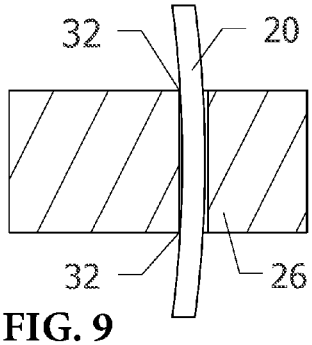
FIG. 9 is a section view of a support column making contact with a shelf as it passes through a guide channel.
Figure 10:
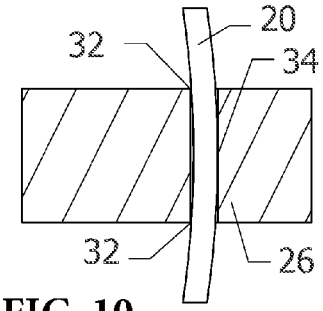
FIG. 10 is a section view of a support column making contact with a shelf as it passes through a guide channel.
Figure 11:
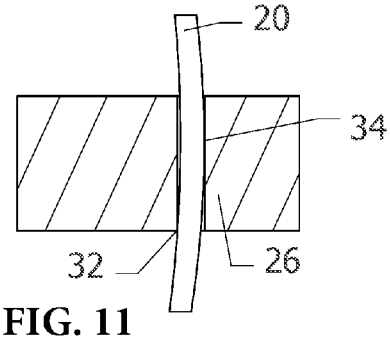
FIG. 11 is a section view of a support column making contact with a shelf as it passes through a guide channel.
Figure 12:
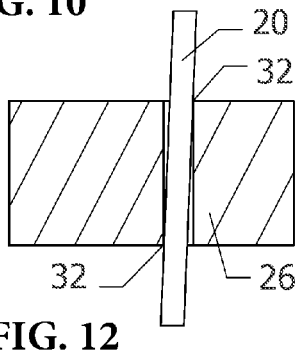
FIG. 12 is a section view of a support column making contact with a shelf as it passes through a guide channel.

Guide channels can be shaped like parallel walled holes that are perpendicular to the shelve surface. FIGS. 9, 10, 11, 12, show various ways the support columns make contact with parallel walled guide channels. FIG. 9 shows the support column 20 can make contact with an inner shelf 26, at two points, at guide channel edge contact points 32, (modality 1). FIG. 10 shows the support column 20 can make contact with an inner shelf 26 at two guide channel contact edge points 32 and the inner wall of a guide channel at inner wall contact point 34. This can happen if the bend in a support column has a small enough radius, (modality 2). FIG. 11 shows the support column 20 can make contact with one guide channel edge at guide channel edge contact point 32 and also make contact with the inner wall at inner wall contact point 34, (modality 3). FIG. 12 shows the support column 20 can make contact with the guide channel edge at two places on the opposite sides of the channel at guide channel edge contact points 32 (modality 4). Each of these four modalities may occur depending on how the support columns are bent as the shelves are positioned relative to each other. Each of these four modalities can develop friction contact points that effectively retain shelf position.

Figure 13:
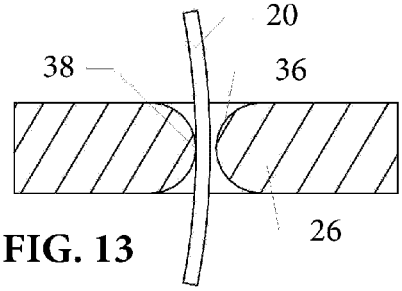
FIG. 13 is a section view of a support column making contact with a shelf as it passes through a catinoid guide channel.

FIG. 13 shows a guide channel in the shape of a catinoid 36 with the support column 20 making contact with the inner shelf 26 at catinoid contact point 38, (modality 5). The catinoid guide channel has an advantage over the parallel guide channel in that it affords smoother shelf sliding over the full range of permitted shelf positions. When parallel walled guide channels are used, and a shelve is moved vertically, different contact modalities come into play, and the force needed to move the shelf can change as modalities change. A parallel walled guide channel is easier to manufacture in a shelf and also encourages the shelves to be horizontal. Whether using parallel guide channels or catinoid guide channels, the shelves are not prohibited from being off horizontal. When using catinoid or parallel guide channels, the ease with which a shelf can be off horizontal is affected by the increasing opposing force exerted by the support columns as the shelf tilts more. Parallel guide channels afford greater resistance to tilt then catinoid guide channels because as the shelf tilts, the support columns will start bending more acutely at various guide channel edge contact points, and the shelves experience greater resistance to tilting the more they tilt. As all the support columns pass through the parallel guide channels, the net lateral forces exerted by the support columns is always minimized when a shelf is horizontal.

Figure 14:
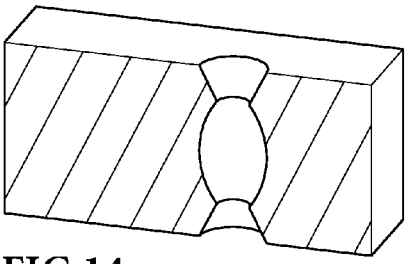
FIG. 14 is a parallel projection section view of a hybrid guide channel.
Figure 15:
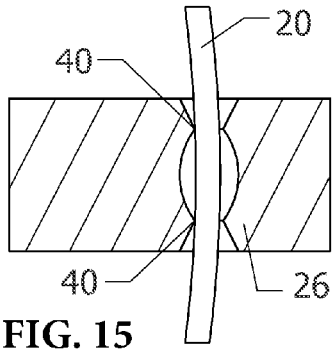
FIG. 15 is a section view of a support column making contact with a shelf as it passes through a hybrid guide channel.
Figure 16:
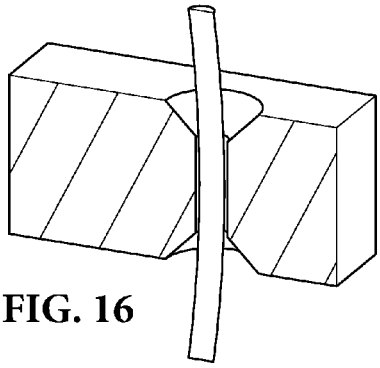
Figure 22:
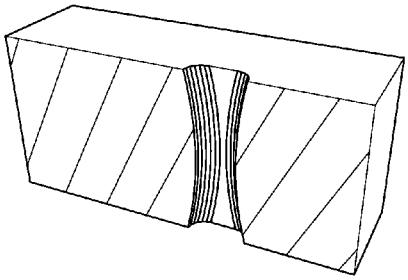
FIG. 22 shows a section view of a perspective showing the interior contour of an oval hybrid guide channel.
Figure 23:
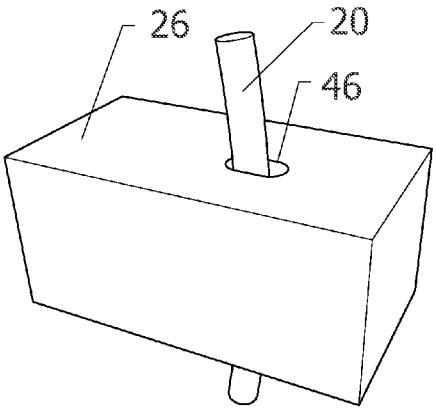
FIG. 23 shows a perspective view of a support column passing through an oval hybrid guide channel in a shelf.

FIG. 14 and FIG. 15 show a hybrid guide channel shape. Like a parallel walled guide channel, a support column 20 can make contact with the inner shelf 26 in two places, at hybrid channel contact points 40. Like a parallel walled guide channel, the hybrid guide channel with its two contact points, encourages a shelf to be horizontal, as greater bending forces are exerted by the two contact points as a shelf is tilted. A catinoid guide channel only has one contact point, and so does not exert as much anti tilting forces as the hybrid guide channel. But the hybrid guide channel is like a catinoid guide channel, in that a support column can't make contact with the inner surface wall, and that will encourage smoother operation as a shelf is moved vertically. FIG. 16 shows a guide channel that is like a shorter version of a parallel walled guide channel, and is like a simplified version of a catinoid guide channel. Like a parallel walled guide channel, it can have two contact points between a shelf and a support column, encouraging a shelf to be horizontal. And like a catinoid guide channel it will have smoother operation as long as the support column does not make contact with the shorter inner wall. FIG. 22 shows the contour of an oval hybrid guide channel that is moderately curved and catinoid like in one vertical plane, but parallel walled in the other vertical plane. FIG. 23 is a perspective of the guide channel shown in FIG. 22, with a support column 20 passing through the oval hybrid guide channel 46 in an inner shelf 26. The oval hybrid guide channel offers smoother operation through the full range of vertical shelf positions, while constraining the support column more tightly along the sides that are not required to deflect, obtaining greater stability and less jiggling when bumped compared to round guide channels.

Most embodiments of the present invention figured in this disclosure show guide channels and anchor holes in the shelves. But guide channels and anchor holes can also be integrated into brackets that are then attached to the shelves. A greater variety of guide channel and anchor hole geometries are possible when using brackets, as the brackets being smaller, can be more easily cast or 3D printed, then entire shelves.

FIG. 8 shows an embodiment of the present invention where the guide channels are staggered in a manner such that the support columns exert only inward lateral force on shelf 26*d*, and only outward lateral forces on inner shelve 26*e*. Inner shelve 26*e* is mildly encouraged to stay horizontal because any tilting will increase the bend on some of the support columns and thus increase the lateral force exerted by those more deflected support columns, and discourage tilt. The support columns are most relaxed when shelf 26*e* is horizontal. Conversely in the case of inner shelve 26*d* where the lateral forces are pushing inward, the shelf is encouraged to tilt, as tilting allows some of the support columns to bend less. The support columns are most relaxed when the shelf is somewhat tilted. In this case, the invention still works because the coefficient of friction between the support columns and the shelves is sufficient to retain a horizontal shelve position, but less robustly then when the lateral forces are pushing outward against shelf corners. FIG. 1 shows a guide channel geometry where every inner shelf has equal components of inward and outward lateral forces, and may be preferred when catinoid guide channels are used or when the coefficient of friction between shelf and support column is low and some shelves are to be position closer together.

Regarding the permitted vertical range of shelf positions, and how close one shelf can be to another, it has been described in paragraph [00032] that as shelves approach one another, the support columns bend more and offer stiffer resistance. As shelves approach each other, the support columns also exert an increasing vertical force component. A vertical force component is missing only when a shelf is in equilibrium between adjacent shelves. The vertical force component grows stronger when adjacent shelves approach each other. As adjacent shelves approach each other the vertical forces exerted by the support columns may overcome the resistive force of the coefficient of friction between the shelf and the support columns in which case the shelf will slide away from the adjacent shelf when the positioning (hand) force is removed. This can happen more readily when catinoid guide channels are used. When parallel guide channels are used and adjacent shelves approach each other, the increasingly bent support columns can make contact with the inner wall of the guide channels and an additional lateral force component is exerted against the inside wall of the guide channel as shown in FIG. 10 and FIG. 11. When this happens, the increased friction enables closer shelf to shelf positioning then what is possible using a catinoid guide channel. When using wooden shelves and stainless steel rods for support columns, using catinoid guide channels demonstrate the bounce back effect more readily as shelves approach each other whereas parallel walled guide channels tend to stay locked tightly together as they approach each other. Catinoid channels can still retain a shelf s position through a useful range of vertical positions. The hybrid guide channel shown in FIG. 16 may be a useful compromise between a longer parallel walled guide channel and a purely catinoid guide channel.

Figure 17:
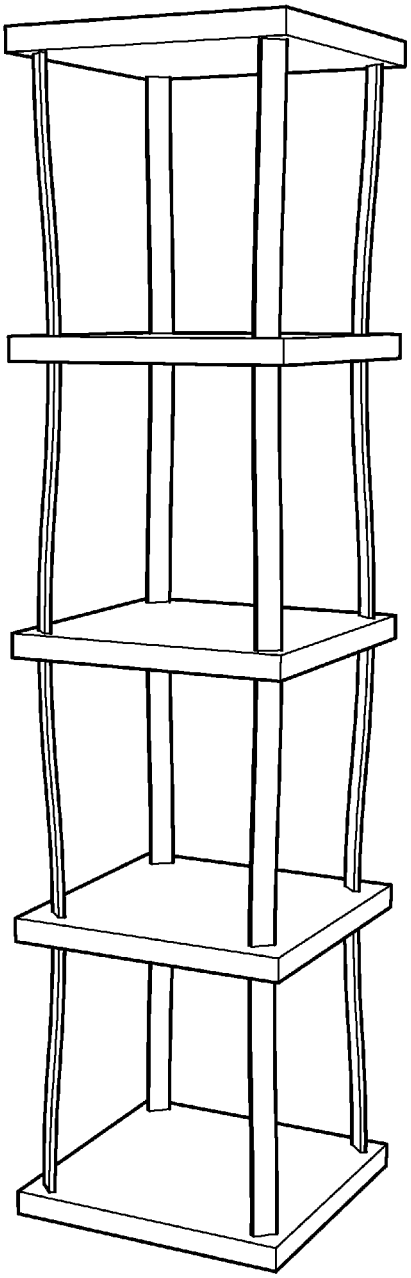
FIG. 17 shows a perspective view of an embodiment of the present invention that uses rectangular support columns.

FIG. 17 shows an embodiment of the present invention where the support columns are rectangular in cross section. The rectangular support columns are not required to bend around their wider cross section, and are only required to bend around their narrower cross section for the invention to work. When an embodiment of the present invention using narrower support column rods is bumped, some jiggling occurs. The resistance to bending around the wider cross section of the rectangular support columns reduces the jiggling that occurs when the embodiment of the present invention shown in FIG. 17 is bumped. In this embodiment, the four support columns are oriented in such a manner as to resist jiggling from any bumping direction. This orientation will also resist twisting around the vertical axis, but twisting is not seen as being very problematic for the disclosed invention.

The disclosed invention has a plurality of support columns of as few as two and as many as a great plurality. Several smaller sized support columns can be used in place of fewer larger sized support columns and achieve similar performance. More support columns may help minimize jiggling when the shelves are bumped. An embodiment of the present invention using a plurality of support columns of varying diameters may help stiffen a structure because any lateral displacement of the structure from a bump will be somewhat countered by the multitude of trapezoid like shapes formed between the varying support columns having slightly different lengths between two shelves because they have different guide channel stagger patterns. The multitude of trapezoid like shapes interacting with each other approximate triangles and thus possibly offering some additional stiffening over the already present stiffness that a simpler embodiment that uses support columns of all of the same diameter and same guide channel stagger pattern.

Figure 18:
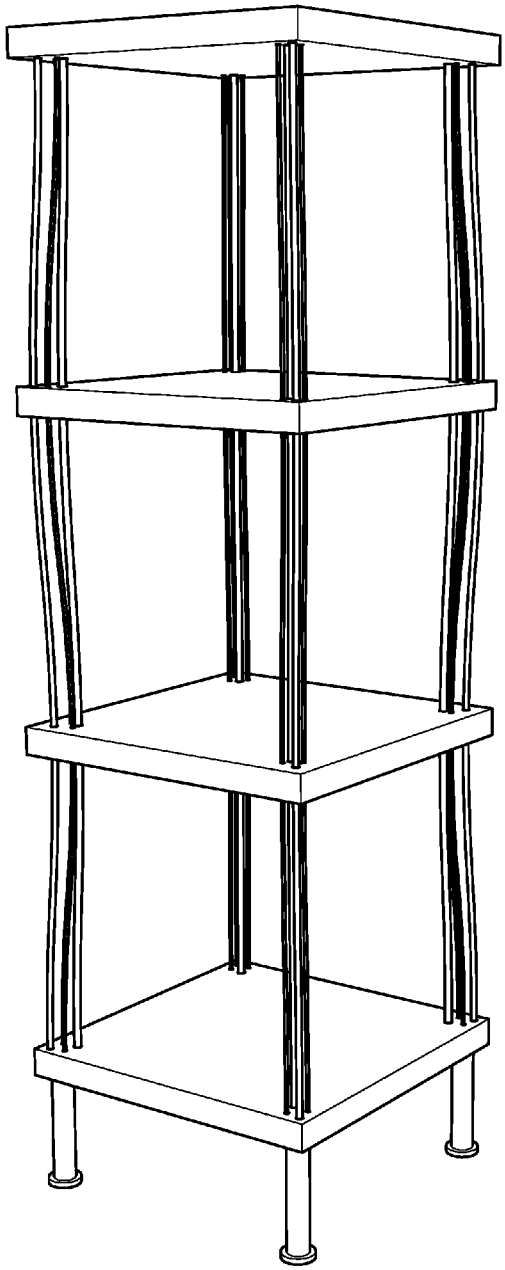
FIG. 18 shows a perspective view of an embodiment of the present invention using 16 support columns of three different diameters.
Figure 19:
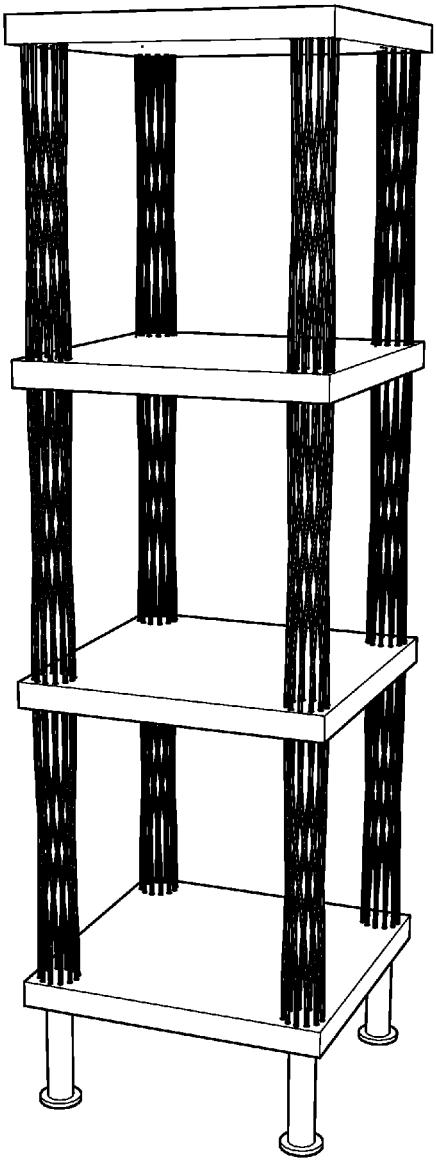
FIG. 19 shows a perspective view of an embodiment of the present invention using 48 support columns forming 4 helical like virtual columns.
Figure 20:
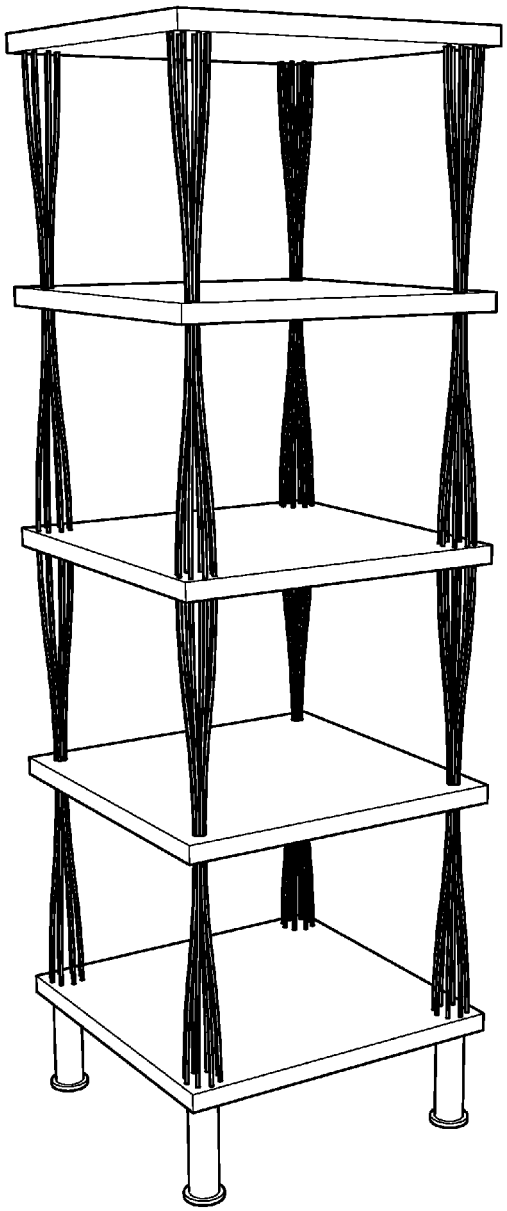
FIG. 20 shows a perspective view of an embodiment of the present invention using 32 support columns that share some guide channels.

FIG. 18 shows an embodiment of the present invention that uses 16 support columns of three different diameters with three different radially symmetric guide channel stagger patterns (a unique stagger pattern for each different support column diameter). FIG. 19 shows an embodiment of the present invention using 48 support columns (12 in each corner) arranged in a circular pattern and appearing like four helical columns (one in each corner). FIG. 20 shows an embodiment of the present invention with 32 support columns (eight in each corner), where two of the inner shelves have larger corner guide channels that all eight of each corners support columns pass through.

Figure 21:
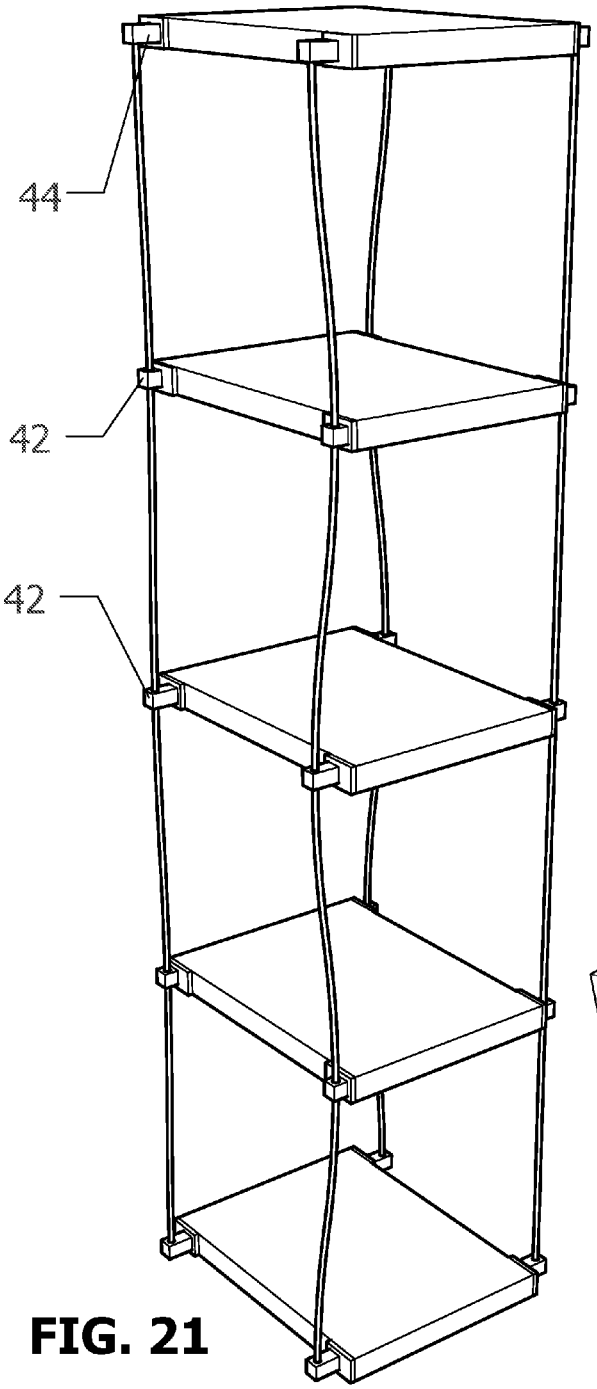
FIG. 21 shows a perspective view of an embodiment of the present invention that uses attachable guide channel brackets and anchor point brackets to constrain support columns at the inner shelves, and anchor support column ends at the top and bottom shelves.

FIG. 21 shows an embodiment of the present invention incorporating a plurality of guide channel brackets 42, attached to the inner shelves, and a plurality of anchor point brackets 44, attached to the top and bottom shelves. The guide channel brackets 42 and anchor point brackets 44 can be mechanically attached to a shelf in some manner as with a screw, or can be glued to a shelf, or can be inserted into a cavity in a shelf. guide channel brackets 42 and anchor point brackets 44 can be made of any material strong enough to withstand the lateral forces applied against them by deflected support columns without significantly distorting, a materiel like wood, metal, or plastic, or other substance. Guide channel brackets and anchor point brackets may be adjustable in that they can reposition the guide channels or anchor points horizontal location. This might be useful for calibrating the geometry for varying loads, or for changing the shelf to shelf proximity geometry. Adjusting the guide channel and anchor point horizontal location with an adjustable guide channel bracket and adjustable anchor hole bracket would not be required when repositioning the shelves vertically within a permitted vertical range, but might only be used to initially calibrate the embodiment.

Figure 24:
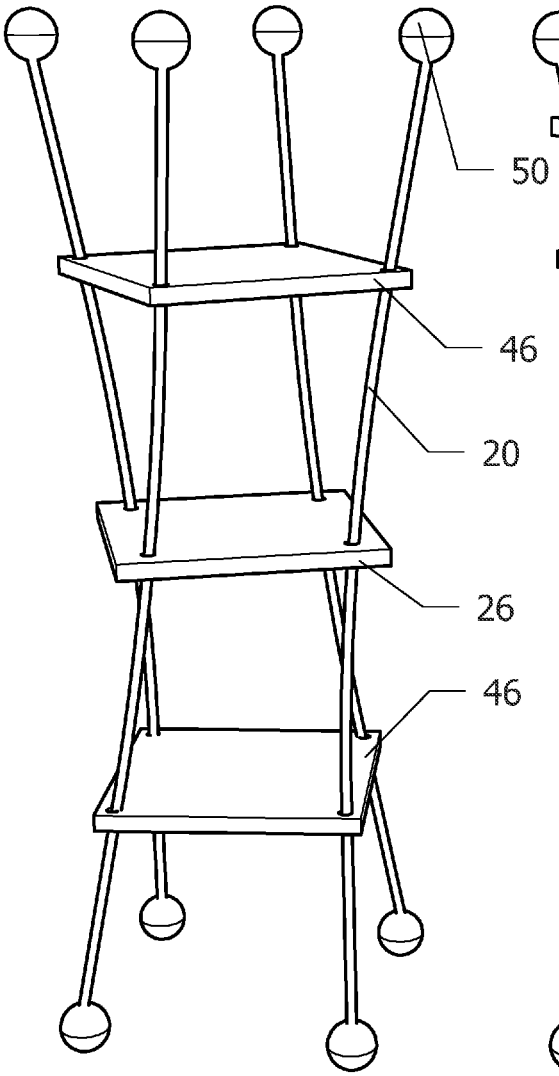
FIG. 24 shows a perspective view of an embodiment of the present invention that is twisted.
Figure 25:
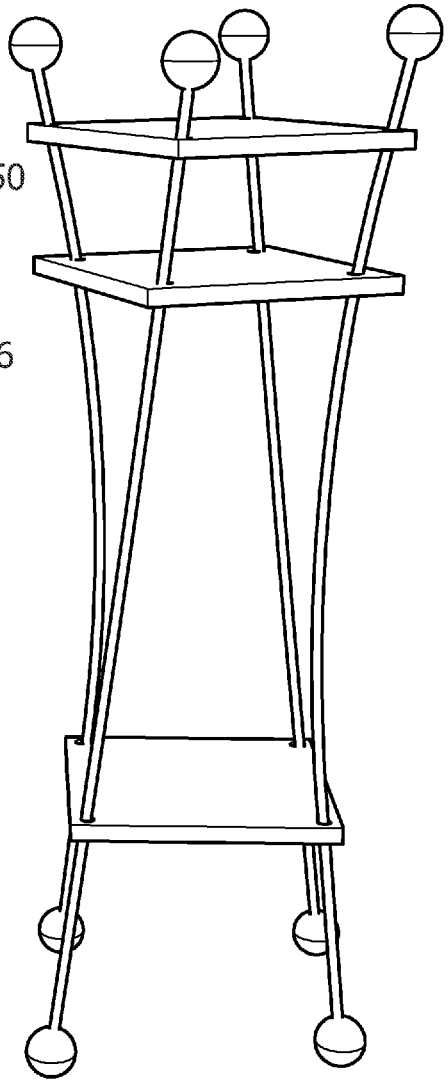
FIG. 25 shows a perspective view of the embodiment of the present invention shown in FIG. 24, but with some shelves repositioned.

FIG. 24 and FIG. 25 show an embodiment of the present invention with two outer shelves 46, one inner shelf 26, four support columns 20, and support column caps 48 on the ends of the support columns. The guide channels are parallel walled. The guide channels on the inner shelf are slightly closer together then the guide channels on the outer shelves, forcing the support columns to bend elastically. The support columns are not fixed to any shelves. The relationship between the cross-section of the support columns and the width and length (the length being the shelf thickness in this case) of the guide channels along with the lateral force exerted on the shelves by the elastically bent support columns, causes the structure to twist into a stable twisted configuration. The greater the difference between the guide channel width and the support column cross-section, the greater the twist. The shorter the guide channel the greater the twist. The structure will twist in either direction depending on the bias applied when adjusting a shelf or shelves. All of the shelves are free to move up or down. The further away from an adjacent shelf that a shelf gets, the less lateral force being applied to a shelf by the elastically bent support columns, and thus the less force of friction holding a self in place. A good ratio of guide channel width and length to support column cross-section size, along with an appropriate amount of lateral force from the elastically bent support columns, will produce a shelving structure with a broad range of shelf positions and configurations that will support moderate loads and can be adjusted by hand. Materials ideal for this embodiment are hard wood shelves and stainless steel rods or tubes for support columns.

Figure 26:
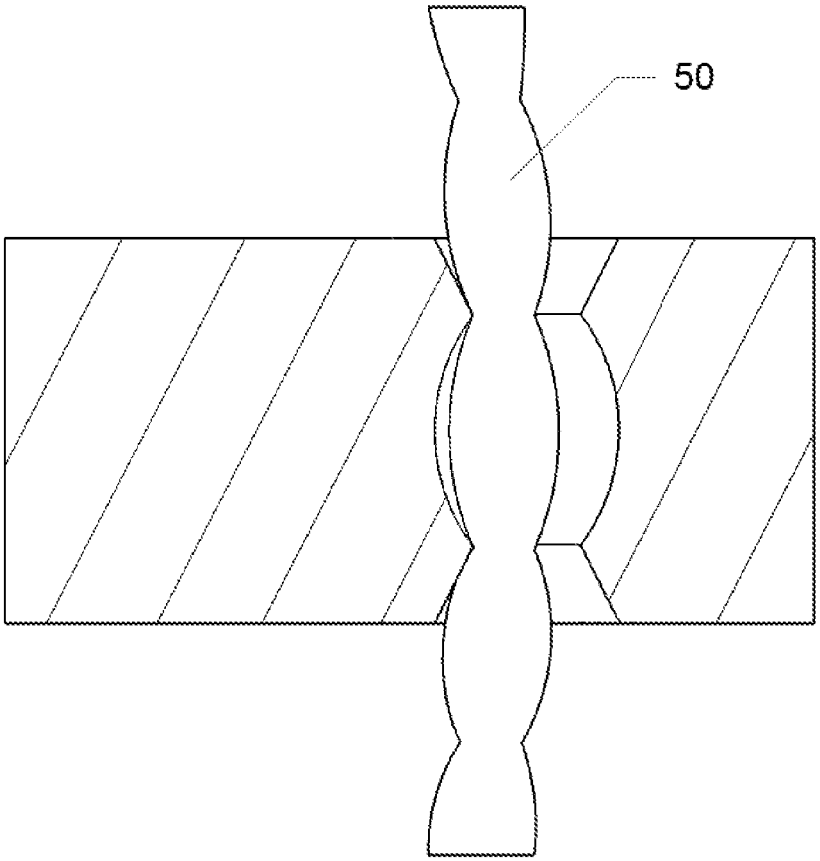
FIG. 26 shows a section view of an articulated support column bulge nested in a guide channel pocket.

An embodiment of the present invention uses hybrid guide channels like that shown in FIG. 14. FIG. 26 shows a support column regularly spaced with rounded football like bulges 50, that can pass through a hybrid guide channel, but also catch into the spheroid like pocket of the guide channel. The totality of support columns being fixed to the top and bottom shelves are aligned horizontally, the regularly spaced bulges all aligned such that a shelf can be easily eye-balled and set into horizontal. The possible shelf positions being indexed by the articulated support columns. Unlike other embodiments of the present invention that use essentially smooth, non-articulated support columns, where inner shelves can be positioned finely, the articulated columns reduce the number of potential shelf positions, but make it easier to position a shelf horizontally.

Shelves can have a variety of shapes like rectangular, or round, or organic in circumference. Only square, rectangular and triangular shelves have been illustrated. The disclosed invention has a plurality of shelves where the number of shelves that can be incorporated is governed by the geometry, materials, and forces at play and could be as few as a top shelve and a bottom shelve and one inner shelve, or as many shelves as can fit between the top and bottom shelves, where the inner shelves nearly touching each other and nearly touch the adjacent top and bottom shelves. While it may be hard to see any value in an embodiment of the present invention with a near maximum number of closely packed shelves, it is never the less allowed and might have practice.

The disclosed invention can be as small as or smaller than six inches tall and one inch across, possibly for the storage and display of rings, earrings or other jewelry or knick-knacks. An embodiment of the present invention could be in the range of six to eighteen inches tall and one to five inches wide and may be used to store and display knickknacks and collectibles, or organize everyday object like tape roles or remote controls. An embodiment of the presented invention could be eighteen inches to eight feet tall and could be used as furniture, like end tables, book stands, and book shelves, and merchandise displays in retail stores. The overall size, and mass, and the vertical to horizontal proportions, and the number of support columns, and the number of shelves of the disclosed invention is only limited by what can be operated by hand.

What is claimed is:

1. A freestanding adjustable shelving assembly comprising:

a plurality of elastically deflectable support columns, each support column having a top end and a bottom end;

a bottom shelf, a top shelf and a plurality of interposed shelves, each comprising a plurality of corners;

the bottom shelf and the top shelf each having a bottom surface and a top surface, and anchor holes disposed in the bottom surface of the top shelf and in the top surface of the bottom shelf, each anchor hole being adjacent to a respective one of the plurality of corners, such that the bottom ends of each of the elastically deflectable support columns are attached to the anchor holes in the top surface of the bottom shelf, and the top ends of each of the elastically deflectable support columns are attached to the bottom surface of the top shelf;

each of the interposed shelves having a top surface and a bottom surface and guide channels extending through the top surface and the bottom surface thereof, and being located adjacent each corner thereof, whereby each of the guide channels defines an inner wall surface, whereby each of the elastically deflectable support columns extends through the guide channels of the interposed shelves, so that the elastically deflectable support columns are in slidable communication with the guide channels;

whereby the guide channels in a first one of the interposed shelves are staggered with respect to a second one of the interposed shelves located immediately above or below the first one of the interposed shelves, such that the elastically deflectable support columns are bent along the length thereof between the top and bottom shelves, thereby (a) creating lateral contact pressure between the elastically deflectable support columns and the wall surfaces of the guide channels, thereby creating a friction force, such that the friction force prevents each of the interposed shelves from sliding along the elastically deflectable support columns under a sufficient vertical load, and (b) allowing for each of the interposed shelves to be adjusted to a different vertical position along the elastically deflectable support columns when a temporary vertical force, which is greater than the friction force, is applied to the respective interposed shelf.

2. The freestanding adjustable shelving assembly of claim 1, wherein each of the guide channels is a cylindrical through hole.

3. The freestanding adjustable shelving assembly of claim 1, wherein each of the guide channels is a cylindrical through hole with beveled edges.

4. The freestanding adjustable shelving assembly of claim 1, wherein each of the guide channels is a catinoid shaped through hole.

5. The freestanding adjustable shelving assembly of claim 1, wherein each of the guide channels is a partial catinoid shaped figure in one vertical plane and having parallel walls in a perpendicular vertical plane.

6. The freestanding adjustable shelving assembly of claim 1, wherein each of the guide channels is a partial catinoid shaped figure through hole, with a spheroid shaped void interposed in a mid section of the partial catinoid shaped figure.

7. The freestanding adjustable shelving assembly of claim 6, wherein each of the elastically deflectable support columns is regularly articulated with bulges that catch into the spheroid shaped voids of the guide channels.

8. The freestanding adjustable shelving assembly of claim 1, wherein each of the elastically deflectable support columns is round in cross section.

9. The freestanding adjustable shelving assembly of claim 1, wherein each of the elastically deflectable support columns is square in cross section.

10. The freestanding adjustable shelving assembly of claim 1, wherein each of the elastically deflectable support columns is rectangular in cross section.

11. The freestanding adjustable shelving assembly of claim 1, wherein the top, bottom, and interposed shelves are each triangular in shape.

12. The freestanding adjustable shelving assembly of claim 1, wherein the bottom surface of the bottom shelf is adapted to rest directly on a supporting surface.

13. The freestanding adjustable shelving assembly of claim 1, wherein the bottom surface of the bottom shelf is adapted to extend above a supporting surface.

14. The freestanding adjustable shelving assembly of claim 1, wherein the top, bottom, and interposed shelves are each substantially rectangular in shape.

* * * * *